United States Patent [19]

Rüdiger

[11] 4,135,334

[45] Jan. 23, 1979

[54] DUST EXHAUST HOOD

[75] Inventor: Günter Rüdiger, Gothenburg, Sweden

[73] Assignee: Firma Robert Bosch GmbH, Fed. Rep. of Germany

[21] Appl. No.: 727,077

[22] Filed: Sep. 27, 1976

[51] Int. Cl.[2] ..... B24B 55/06

[52] U.S. Cl. ..... 51/273

[58] Field of Search ..... 51/273, 268, 170 T, 51/177

[56] References Cited

U.S. PATENT DOCUMENTS

| | | | |
|---|---|---|---|
| 1,643,882 | 9/1927 | Faiver | 51/170 T |
| 2,384,688 | 9/1945 | Litman | 51/273 |
| 3,673,744 | 7/1972 | Oimoen | 51/273 |
| 3,701,221 | 10/1972 | Vinella | 51/177 |

*Primary Examiner*—Harold D. Whitehead
*Assistant Examiner*—Roscoe V. Parker
*Attorney, Agent, or Firm*—William Anthony Drucker

[57] ABSTRACT

A dust exhausting hood is for use with surface working machines such as surface grinders. To enable the hood to remain in close contact with the surface being worked, a mantle which surrounds the working tool is connected to a mounting ring, engaged on the machine head, by guide means which permit both axial movement and tilting of the mantle of the hood with respect to its mounting ring, the mantle being constantly urged into contact with the worked surface by means of a compression spring acting between the mounting ring and the mantle. To permit maximum axial movement of the mantle, within limits, with respect to the mounting ring, the spring is a helical spiral spring which can be compressed into planar form.

4 Claims, 2 Drawing Figures

DUST EXHAUST HOOD

The present invention relates to a dust exhaust hood for a grinding or other machine.

OBJECT OF THE INVENTION

It is a the object of the invention to provide a hood which remains closely in engagement with the surface treated by the machine, irrespective within limits of the degree of wear of the working tool, and its angle of attack.

SUMMARY OF THE INVENTION

A dust exhausting hood, for mounting on a head of a surface-treating machine so as to surround a rotary tool of the machine, comprises a clamping ring for placing about the head of the machine coaxially with the rotary tool, means for releasably tightening said clamping ring into engagement with the machine head, guide means integral with said clamping ring, said guide means including a first portion extending radially outwards from said ring, and a second portion extending from said first portion substantially parallel to the axis of the ring, a mantle having a side wall and an apertured top wall, the lower end of the mantle being open, said mantle being disposed with its side wall positioned within an area bounded by the guide means, the side wall being connected to the guide means for relative movement of the mantle axially with respect to the guide means, and a helical spiral spring engaged under compression between the first portion of the guide means and the top wall of the mantle, to urge the mantle axially away from the clamping ring.

BRIEF DESCRIPTION OF THE DRAWINGS

An embodiment of the invention is hereinafter described in detail with reference to the accompanying drawings.

In the drawings.

DESCRIPTION OF THE PREFERRED EMBODIMENT

Figure 1:
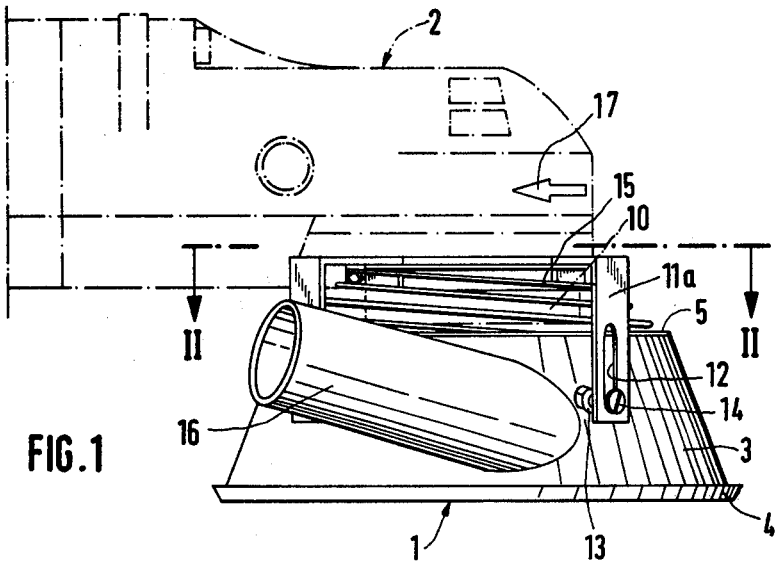
FIG. 1 is a side elevation of an exhaust hood, provided with the device of the present invention, mounted on a working machine.
Figure 2:
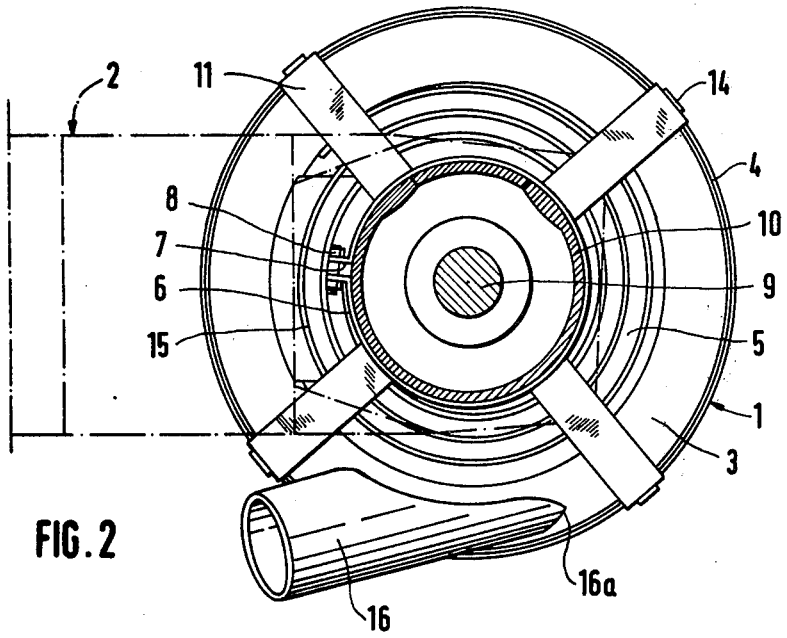
FIG. 2 is a cross-section taken on the line II—II in FIG. 1.

In the drawing an exhaust hood 1 is mounted on a grinding machine 2. The exhaust hood with its mounting device has been indicated with continuous lines, while the body of the machine 2 has been indicated with broken lines. The hood has a mantle 3 of the shape of a truncated cone, of which the edge 4 is lipped, so that this edge does not damage the surface intended to be ground, when the working machine is fed along the same. The mantle 3 joins to a substantially plane end wall 5, through the center of which the shaft of the grinding machine extends. An attachment device, denoted in its entirety by reference 6, comprises a clamping ring 7 through the flanged end portions of which a clamping bolt 8 is engaged. The clamping ring 7 is clamped around a cylindrical portion 10 of the body of the working machine, projecting in the same direction as the shaft 9. A number of flat bars 11, which form a number of bridges radially extending from the clamping ring 7, have their outer end portions **11*a* bent to extend parallel to the shaft of the machine. The portions 11*a* have longitudinal slots 12, through which extend screws 14, which are engaged into nuts 13 welded to the mantle of the protective hood, said screws together with the slots 12 forming a sliding guide for the exhaust hood, the end positions of which are determined by the ends of the slots 12. A helical spiral pressure spring 15, is fitted under compression between the hood 1 and the clamping ring 7. The wider end of the spring 15 bears against the hood, and its narrower end bears against the attachment device 6. The spring 15 tends to move the hood into the position illustrated in FIG. 1, in which the screws 14 are contacting the lower end of the slots 12. A suction pipe 16 opens into the mantle 3 of the hood and extends tangentially to the hood. The pipe 16 is intended to be connected to a dust exhaust device remainder of the pipe. The direction of rotation of the grinding disc, not shown in the drawing, is indicated with an arrow 17** on the machine body.

When the grinding machine is pressed against the surface to be ground, the spring 15 is compressed, and it presses the hood against the surface irrespective of the working position of the grinding disc relative to said surface to be machined.

I claim:

1. A dust exhausting hood, for mounting on a head of a surface-treating machine so as to surround a rotary tool of the machine, comprising:

(i) a clamping ring for placing about the head of the machine coaxially with the rotary tool (ii) means for releasably tightening said clamping ring into engagement with the machine head (iii) guide means integral with said clamping ring, said guide means including a first portion extending radially outwards from said ring, and a second portion extending from said first portion substantially parallel to the axis of the ring, (iv) a mantle having a side wall and an apertured top wall, the lower end of the mantle being open, said mantle being disposed with its side wall positioned within an area bounded by the guide means, the side wall being connected to the guide means for relative movement of the mantle axially with respect to the guide means (v) a helical spiral spring engaged under compression between the first portion of the guide means and the top wall of the mantle, to urge the mantle axially away from the clamping ring; and (vi) means associated with said mantle side wall for exhausting dust from said hood.

2. A dust exhausting hood, as claimed in claim 1, wherein said guide means comprise a plurality of bridge elements disposed at equal angular intervals about the axis of the ring, each element including a flat radial first bar portion, and a flat second bar portion extending from the free end of the first portion parallel to the axis of the ring, said second portion being slotted, said slots each receiving a respective bolt threaded into a nut secured on the side wall of the mantle.

3. A dust exhausting hood, as claimed in claim 1, wherein said side wall of said mantle is frusto-conical, and said top wall is at the smaller end of said side wall.

4. A dust exhausting hood, as claimed in claim 1, wherein said dust exhausting means is an exhausting pipe mounted on the side wall of the mantle and communicating with the interior of the mantle through an opening in the side wall, the pipe having a central longitudinal axis which is substantially tangential to a circle coaxial with the axis of the ring.

* * * * *